US009509106B2

(12) United States Patent
Nakamura

(10) Patent No.: US 9,509,106 B2
(45) Date of Patent: Nov. 29, 2016

(54) COAXIAL CONNECTOR PLUG

(71) Applicant: MURATA MANUFACTURING CO., LTD., Nagaokakyo-shi, Kyoto (JP)

(72) Inventor: Shingo Nakamura, Nagaokakyo (JP)

(73) Assignee: Murata Manufacturing Co., Ltd., Kyoto-Fu (JP)

( * ) Notice: Subject to any disclaimer, the term of this patent is extended or adjusted under 35 U.S.C. 154(b) by 0 days.

(21) Appl. No.: 14/522,845

(22) Filed: Oct. 24, 2014

(65) Prior Publication Data

US 2015/0207278 A1 Jul. 23, 2015

(30) Foreign Application Priority Data

Jan. 22, 2014 (JP) ..... 2014-009375

(51) Int. Cl.
*H01R 9/05* (2006.01)
*H01R 24/50* (2011.01)

(52) U.S. Cl.
CPC ..... *H01R 24/50* (2013.01)

(58) Field of Classification Search
CPC ..... H01R 9/0518; H01R 17/12
USPC ..... 439/582, 578–581, 583–585, 350–358
See application file for complete search history.

(56) References Cited

U.S. PATENT DOCUMENTS 5,110,308 A 5/1992 Nishikawa et al.
5,322,453 A * 6/1994 Resnick et al. ..... 439/581
5,597,323 A * 1/1997 Resnick et al. ..... 439/582
6,416,357 B1 7/2002 Ko
6,902,408 B2 * 6/2005 Yamane ..... H01R 24/50 439/581
8,096,828 B2 1/2012 Ellis et al.
8,419,463 B2 4/2013 Taguchi
2004/0061131 A1 4/2004 Winslow
2010/0190376 A1 * 7/2010 Chen ..... H01R 24/50 439/578

(Continued)

FOREIGN PATENT DOCUMENTS

CN 1512634 A 7/2007
CN 103094754 A 5/2013

(Continued)

OTHER PUBLICATIONS

An Office Action issued by the Taiwanese Patent Office on May 17, 2016, which corresponds to Taiwanese Patent Application No. 103135341 and is related to U.S. Appl. No. 14/522,845; with English language translation.

*Primary Examiner* — Tulsidas C Patel
(74) *Attorney, Agent, or Firm* — Studebaker & Brackett PC

(57) ABSTRACT

A coaxial connector plug includes a first outer conductor with a cylinder shape extending in a first direction, a first center conductor that has a cylinder shape extending in the first direction and is provided inside the first outer conductor, and an insulation member that fixes the first center conductor to the first outer conductor. In the coaxial connector plug, a communication section to cause the inside and the outside of the first center conductor to communicate with each other is provided in an end portion of the first center conductor on one side in the first direction. A width of the communication section in a second direction orthogonal to the first direction becomes larger as it progresses from the one side toward the other side of the first direction, and the insulation member penetrates from the outside to the inside of the first center conductor through the communication section.

12 Claims, 10 Drawing Sheets

(56) References Cited

U.S. PATENT DOCUMENTS

| | | | | |
|---|---|---|---|---|
| 2012/0122339 | A1* | 5/2012 | Taguchi ..... | H01R 13/504 439/578 |
| 2013/0115810 | A1 | 5/2013 | Maruyama et al. | |

FOREIGN PATENT DOCUMENTS

| | | | |
|---|---|---|---|
| JP | 2013098122 | A | 5/2013 |
| TW | 318835 | U | 9/2007 |

* cited by examiner

COAXIAL CONNECTOR PLUG

CROSS REFERENCE TO RELATED APPLICATIONS

This application claims benefit of priority to Japanese Patent Application No. 2014-009375 filed Jan. 22, 2014, the entire content of which is incorporated herein by reference.

TECHNICAL FIELD

The present technical field relates to coaxial connector plugs, specifically, coaxial connector plugs including a cylinder-shaped outer conductor and a center conductor provided at the inside of the outer conductor.

BACKGROUND

As an existing coaxial connector plug, a coaxial connector plug disclosed in Japanese Unexamined Patent Application Publication NO. 2013-98122 is known, for example. FIG. 12 is a cross-sectional structure view of a coaxial connector plug 510 disclosed in Japanese Unexamined Patent Application Publication NO. 2013-98122. FIG. 13 is a planar view of a center conductor 514*a*, viewed from the front side, of the coaxial connector plug 510 disclosed in Japanese Unexamined Patent Application Publication NO. 2013-98122.

The coaxial connector plug 510 includes, as shown in FIG. 12, an outer conductor member 512, a center conductor 514*a*, and insulation member 516. The outer conductor member 512 includes an outer conductor 512*a* and an outer terminal 512*b*.

The outer conductor 512*a* is formed in a cylinder shape extending in the vertical direction. The outer terminal 512*b* is extended to the lower side of the outer conductor 512*a*, and is bent into a direction which is distanced from the outer conductor 512*a* when viewed from above.

The insulation member 516 is a plate member configured to close an opening at a lower end of the outer conductor 512*a* and is made from resin. The center conductor 514*a* is integrally attached to the insulation member 516 through insert molding, and is provided in a region surrounded by the outer conductor 512*a*.

Note that, as shown in FIG. 13, a hole H is provided on a side surface of the center conductor 514*a*. Further, as shown in FIG. 12, the insulation member 516 penetrates into the inside of the center conductor 514*a* through the hole H. This suppresses the center conductor 514*a* from being easily detached from the insulation member 516 in the coaxial connector plug 510.

It is required to lower the height of the above-described coaxial connector plug 510 in the vertical direction (hereinafter, to lower the height is referred to as "low-profiling").

SUMMARY

Accordingly, it is an object of the present disclosure to provide a coaxial connector plug that is capable of realizing low-profiling.

A coaxial connector plug according to an aspect of the present disclosure includes a first outer conductor that is formed substantially in a cylinder shape extending in a first direction, a first center conductor that is formed substantially in a cylinder shape extending in the first direction and is provided at the inside of the first outer conductor, and an insulation member that fixes the first center conductor to the first outer conductor. Further, in the stated coaxial connector plug, a communication section configured to cause the inside and the outside of the first center conductor to communicate with each other is provided in an end portion of the first center conductor on one side in the first direction. A width of the communication section in a second direction orthogonal to the first direction is larger as it progresses from the one side toward the other side of the first direction in at least part of the communication section. The insulation member penetrates from the outside to the inside of the first center conductor through the communication section.

In the coaxial connector plug, it is preferable that the insulation member close an opening of the first outer conductor on one side in the first direction, and the end portion of the first center conductor on the one side in the first direction be exposed from a surface of the insulation member on one side in the first direction.

In the coaxial connector plug, it is preferable that the first center conductor be configured such that a belt-shaped plate member is bent in a substantially circular form so that both ends in a longitudinal direction of the plate member are bonded.

In the coaxial connector plug, it is preferable that the communication section be formed by providing a cutout in at least one of both the ends in the longitudinal direction of the plate member.

In the coaxial connector plug, it is preferable that the first center conductor be formed substantially in a cylinder shape.

In the coaxial connector plug, it is preferable that the insulation member be made from resin.

In the coaxial connector plug, it is preferable that a substantially cylinder-shaped second outer conductor of a coaxial connector receptacle be inserted into the first outer conductor, and a second center conductor of the coaxial connector receptacle be inserted into the first center conductor.

According to the present disclosure, low-profiling can be realized.

Other features, elements, characteristics and advantages of the present disclosure will become more apparent from the following detailed description of preferred embodiments of the present disclosure with reference to the attached drawings.

DETAILED DESCRIPTION

Hereinafter, a coaxial connector plug according to an embodiment of the present disclosure will be described.

Configuration of Coaxial Connector

Figure 1:
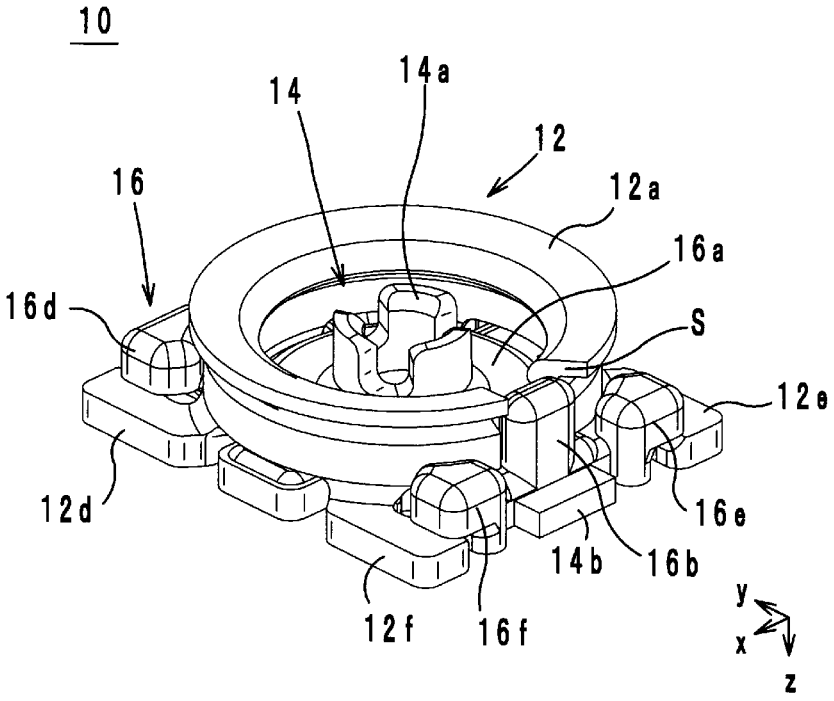
FIG. 1 is an exterior perspective view of a coaxial connector plug according to an embodiment of the present disclosure.
Figure 2:
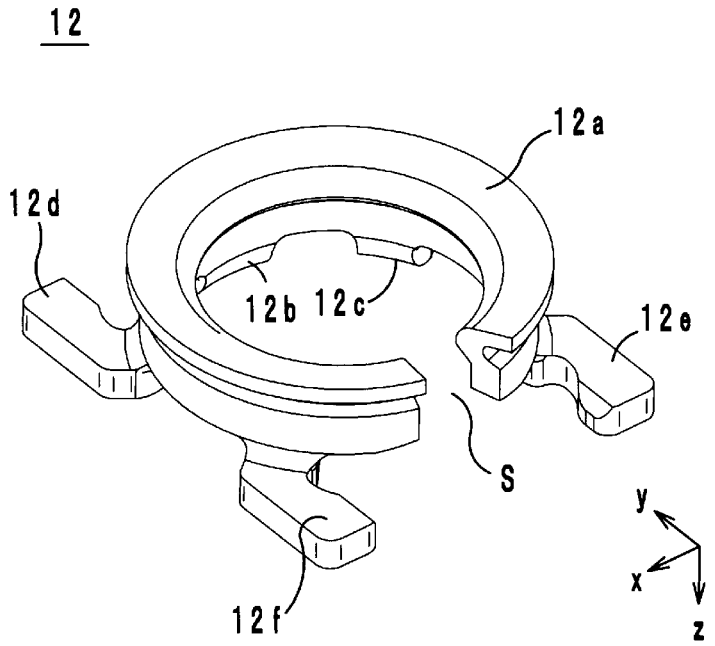
FIG. 2 is an exterior perspective view of an outer conductor member of the coaxial connector plug.
Figure 3:
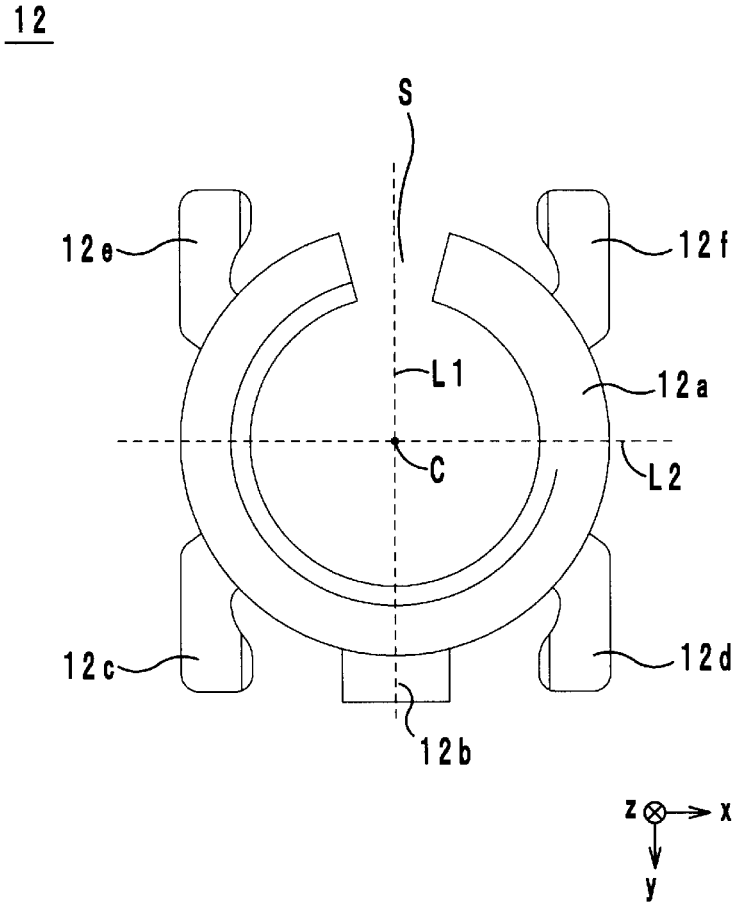
FIG. 3 is a planar view of the outer conductor member when viewed from above in a z-axis direction.
Figure 4A:
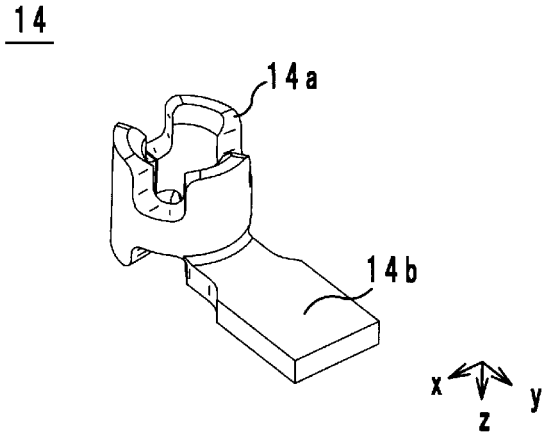
FIG. 4A is an exterior perspective view of a center conductor member of the coaxial connector plug.
Figure 4B:
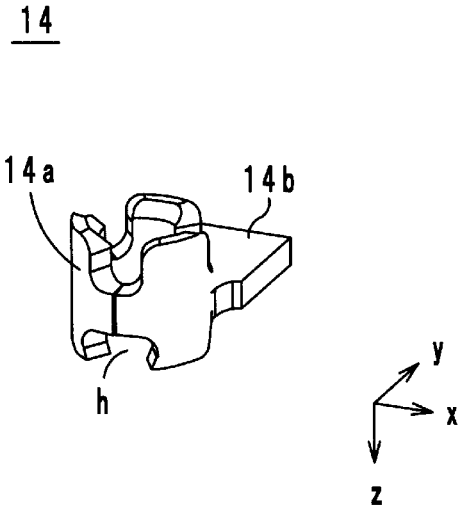
FIG. 4B is also an exterior perspective view of the center conductor member of the coaxial connector plug.
Figure 4C:
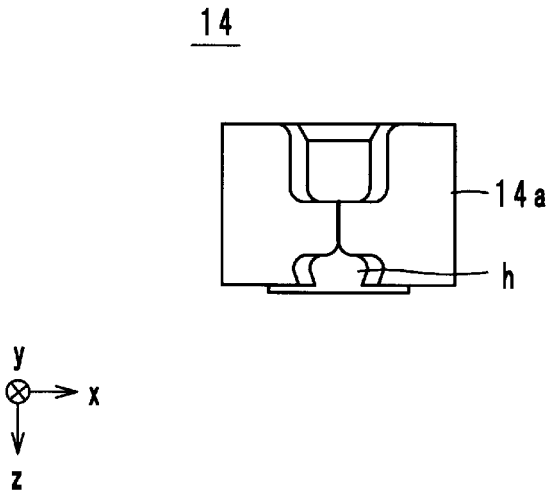
FIG. 4C is a planar view of the center conductor member of the coaxial connector plug.
Figure 4D:
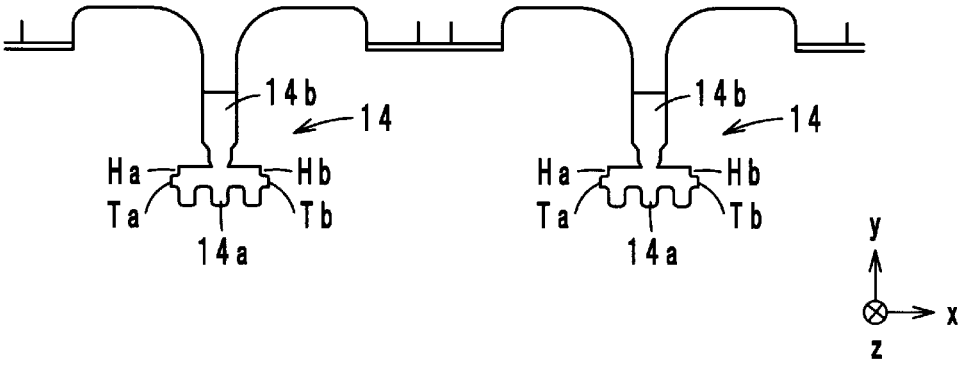
FIG. 4D is a diagram illustrating the center conductor member of the coaxial connector plug in a state of being assembled.
Figure 4E:
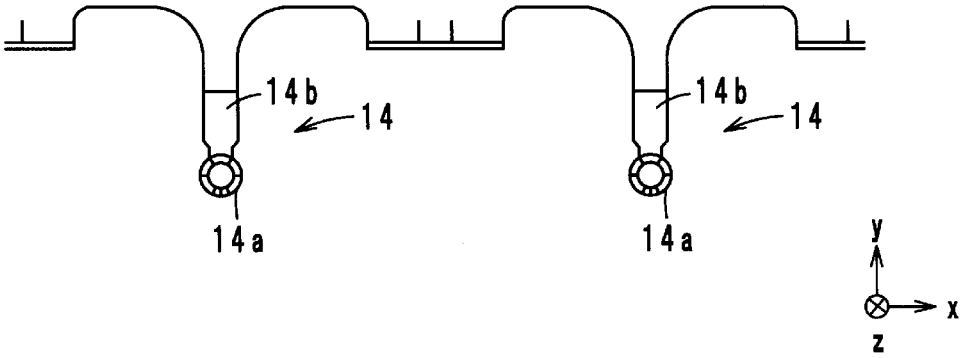
FIG. 4E is a diagram also illustrating the center conductor member of the coaxial connector plug in a state of being assembled.
Figure 5A:
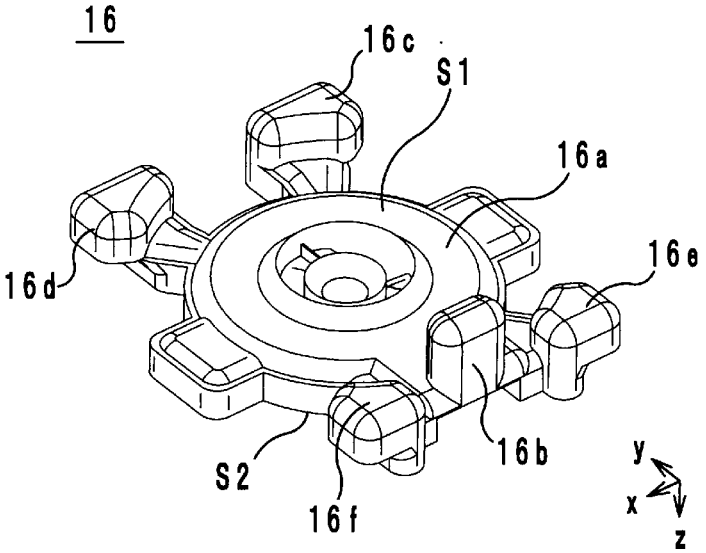
FIG. 5A is an exterior perspective view of an insulation member of the coaxial connector plug.
Figure 5B:
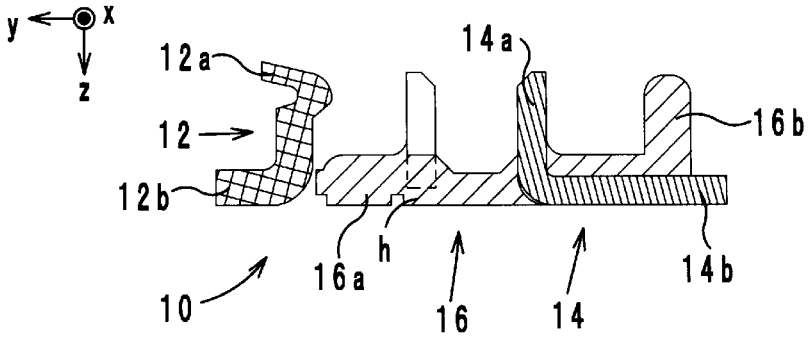
FIG. 5B is a cross-sectional structure view of the coaxial connector plug.

First, a coaxial connector plug according an embodiment of the present disclosure will be described with reference to the drawings. FIG. 1 is an exterior perspective view of a coaxial connector plug 10 according to the embodiment of the present disclosure. FIG. 2 is an exterior perspective view of an outer conductor member 12 of the coaxial connector plug 10. FIG. 3 is a planar view of the outer conductor member 12 when viewed from above in a z-axis direction. FIG. 4A and FIG. 4B are exterior perspective views of a center conductor member 14 of the coaxial connector plug 10. FIG. 4C is a planar view of the center conductor member 14 of the coaxial connector plug 10 when seen in the y-axis direction. FIG. 4D and FIG. 4E are diagrams illustrating the center conductor member 14 of the coaxial connector plug 10 in a state of being assembled. FIG. 5A is an exterior perspective view of an insulation member 16 of the coaxial connector plug 10. FIG. 5B is a cross-sectional structure view of the coaxial connector plug 10.

A coaxial connector receptacle, which will be explained later, is attached to the coaxial connector plug 10 from the lower side thereof. In other words, when the coaxial connector plug 10 is in use, the coaxial connector plug 10 is used with an opening thereof facing downward. Note that, for the sake of convenience, the upper direction in FIG. 1 means an upward direction of the vertical direction, and the lower direction in FIG. 1 means a downward direction of the vertical direction. Further, the lower direction in FIG. 1 is defined as a positive direction of the z-axis direction, while the upper direction in FIG. 1 is defined as a negative direction of the z-axis direction.

The coaxial connector plug 10 has a substantially rectangular shape when viewed from above in the z-axis direction, such that, in a planar view of the coaxial connector plug 10 viewed from above in the z-axis direction, directions in which two sides of the coaxial connector plug 10 extend are defined as an x-axis direction and a y-axis direction, respectively. The x-axis direction, the y-axis direction, and the z-axis direction are orthogonal to one another.

The coaxial connector plug 10 is mounted on a circuit board such as a flexible print board or the like, and includes, as shown in FIGS. 1 and 2, the outer conductor member 12, the center conductor member 14, and the insulation member 16.

The outer conductor member 12 is manufactured by performing punching and bending processes on a single metal plate (for example, phosphorus bronze) having conductivity and elasticity. In addition, nickel plating, and silver plating or gold plating are performed on the outer conductor member 12. As shown in FIGS. 1 through 3, the outer conductor member 12 includes a first outer conductor 12*a* and outer terminals 12*b* through 12*f*. The first outer conductor 12*a* is formed substantially in a cylinder shape extending in the z-axis direction, as shown in FIGS. 1 through 3.

Further, as shown in FIGS. 1 through 3, the first outer conductor 12*a* has a cut section S in a portion of its substantially circular shape when viewed from above in the z-axis direction. The cut section S extends in the z-axis direction in the first outer conductor 12*a*. The first outer conductor 12*a* has a structure in which it is open at the cut section S, that is, the conductor is formed in a so-called C shape. In the following description, in a planar view of the first outer conductor 12*a* viewed from above in the z-axis direction, as shown in FIG. 3, the center thereof is referred to as a "center C". Further, a straight line connecting the center C and the cut section S is referred to as a "line L1". The line L1 passes the center of the cut section S. A straight line passing the center C and orthogonal to the line L1 is referred to as a "line L2". The line L1 is parallel to the y-axis direction, while the line L2 is parallel to the x-axis direction.

As shown in FIGS. 2 and 3, the outer terminals 12*b* through 12*f* are connected to the first outer conductor 12*a*. The outer terminals 12*b* through 12*f* are extended from the first outer conductor 12*a* toward the positive direction side of the z-axis direction, and extended in a direction being distanced from the first conductor 12*a* when viewed from above in the z-axis direction.

The outer terminal 12*b* is extended from the first outer conductor 12*a* toward the positive direction side of the z-axis direction and folded back toward a positive direction side of the y-axis direction. To be more specific, the outer terminal 12*b* is, when viewed from above in the z-axis direction, connected with the first outer conductor 12*a* on the positive direction side of the y-axis direction relative to the center C, and is extended in the opposite direction to the direction extending toward the cut section S from the center C (in other words, extended toward the positive direction side of the y-axis direction).

As shown in FIGS. 1 through 3, the outer terminals 12*c* and 12*d* are, when viewed from above in the z-axis direction, provided on the opposite side to the cut section S side relative to the line L2 (in other words, provided on the positive direction side of the y-axis direction). More specifically, the outer terminal 12*c* is, when viewed from above in the z-axis direction, connected with the first outer conductor 12*a* at a position where the cut section S is counterclockwise rotated by 135 degrees about the center C, as shown in FIG. 3. Further, the outer terminal 12*c* is extended from the first outer conductor 12*a* toward the positive direction side of the z-axis direction. Furthermore, the outer terminal 12*c* is, when viewed from above in the z-axis direction, extended in a direction extending from the center C toward the connecting portion of the outer terminal 12*c* and the first outer conductor 12*a*, and then is bent toward the positive direction side of the y-axis direction.

Meanwhile, the outer terminal 12*d* is, when viewed from above in the z-axis direction, connected with the first outer conductor 12*a* at a position where the cut section S is clockwise rotated by 135 degrees about the center C, as shown in FIG. 3. Further, the outer terminal 12*d* is extended from the first outer conductor 12*a* toward the positive direction side of the z-axis direction. Furthermore, the outer terminal 12*d* is, when viewed from above in the z-axis direction, extended in a direction extending from the center C toward the connecting portion of the outer terminal 12*d* and the first outer conductor 12*a*, and then is bent toward the positive direction side of the y-axis direction.

As shown in FIGS. 1 through 3, the outer terminals 12*e* and 12*f* are, when viewed from above in the z-axis direction, so provided as to sandwich the cut section S therebetween on the cut section S side relative to the line L2 (in other words, on a negative direction side of the y-axis direction). More specifically, the outer terminal 12*e* is, when viewed from above in the z-axis direction, connected with the first outer conductor 12*a* at a position where the cut section S is counterclockwise rotated by 45 degrees about the center C, as shown in FIG. 3. Further, the outer terminal 12*e* is extended from the first outer conductor 12*a* toward the positive direction side of the z-axis direction. Furthermore, the outer terminal 12*e* is, when viewed from above in the z-axis direction, extended in a direction extending from the center C toward the connecting portion of the outer terminal 12*e* and the first outer conductor 12*a*, and then is bent toward the negative direction side of the y-axis direction.

Meanwhile, the outer terminal 12*f* is, when viewed from above in the z-axis direction, connected with the first outer conductor 12*a* at a position where the cut section S is clockwise rotated by 45 degrees about the center C, as shown in FIG. 3. Further, the outer terminal 12*f* is extended from the first outer conductor 12*a* toward the positive direction side of the z-axis direction. Furthermore, the outer terminal 12*f* is, when viewed from above in the z-axis direction, extended in a direction extending from the center C toward the connecting portion of the outer terminal 12*f* and the first outer conductor 12*a*, and then is bent toward the negative direction side of the y-axis direction.

As shown in FIG. 3, the outer terminals 12*c* through 12*f* configured in the manner described above do not stick out from the first outer conductor 12*a* in a direction in which the line L2 extends (in other words, in the x-axis direction) when viewed in a direction in which the line L1 extends (in other words, in the y-direction).

The center conductor member 14 is manufactured by performing punching and bending processes on a single metal plate (for example, phosphorus bronze). In addition, nickel plating, and silver plating or gold plating are performed on the center conductor member 14. As shown in FIG. 1 and FIGS. 4A through 4E, the center conductor member 14 includes a first center conductor 14*a* and an outer terminal 14*b*.

As shown in FIG. 1, the first center conductor 14*a* is, when viewed from above in the z-axis direction, provided in a region surrounded by the first outer conductor 12*a* (specifically, at the center C of the first outer conductor 12*a*). Further, the first center conductor 14*a* is formed substantially in a cylinder shape extending in the z-axis direction, as shown in FIGS. 4A and 4B. In the first center conductor 14*a*, there are provided three slits extending in the vertical direction. This makes it possible for the first center conductor 14*a* to be slightly stretched in the horizontal direction.

The outer terminal 14*b* is connected to an end portion of the first center conductor 14*a* on the positive direction side of the z-axis direction, and is linearly extended toward the positive direction side of the y-axis direction, as shown in FIGS. 4A and 4B.

Note that, in an end portion of the first center conductor 14*a* on the positive direction side of the z-axis direction, there is provided a communication section "h" that causes the inside and the outside of the first center conductor 14*a* to communicate with each other, as shown in FIGS. 4B and 4C. Hereinafter, the communication section h will be described along with the description of a manufacturing process of the center conductor member 14.

The communication section h is formed by cutting out part of the end portion of the first center conductor 14*a* on the positive direction side of the z-axis direction in the form of a rectangle. That is, the end portion of the first center conductor 14*a* on the positive direction side of the z-axis direction is substantially C-shaped when viewed from above in the y-axis direction. In the present embodiment, when viewed from above in the y-axis direction, part of the first center conductor 14*a* on the positive direction side of the z-axis direction is cut out against the center of the first center conductor 14*a* so as to form the communication section h. With this, the inside and the outside of the first center conductor 14*a* communicate with each other. The shape of the communication section h is an upside-down isosceles trapezoid in which the upper base is longer than the lower base when viewed in the z-axis direction. Such that, the width of the communication section h in the x-axis direction is smaller as it progresses from the positive direction side toward the negative direction side of the z-axis direction.

In manufacturing the center conductor member 14, a single metal plate is punched in the form of a T shape, as shown in FIG. 4D. In the state illustrated in FIG. 4D, the first center conductor 14*a* is a belt-shaped flat plate member extending in the x-axis direction. Cutouts Ha and Hb are provided in the sides located on both ends in the x-axis direction of the first center conductor 14*a*, respectively. Further, in the state illustrated in FIG. 4D, the outer terminal 14*b* is a flat plate member extending from the center in the x-axis direction of the first center conductor 14*a* toward the positive direction side of the y-axis direction. Each end portion of the outer terminal 14*b* on the positive direction side of the y-axis direction is connected to the metal plate so that a plurality of center conductor members 14 are arranged along the x-axis direction.

Next, as shown in FIG. 4E, the first center conductor 14*a* in the form of a flat plate is bent so as to form a cylinder. To be more specific, the first center conductor 14*a* in the form of a flat plate is bent in a substantially circular form so that the sides on both the ends in the x-axis direction of the first center conductor 14*a* are bonded. At this time, the cutouts Ha and Hb are linked to form the communication section h. Further, as shown in FIG. 4E, the first center conductor 14*a* in the form of a cylinder is bent toward the negative direction side of the z-axis direction. With this, the center conductor member 14 is completed.

The insulation member 16 is made from an insulative material such as resin or the like, and has a function to fix the center conductor member 14 to the outer conductor member 12. The insulation member 16 includes, as shown in FIG. 5A, a base portion 16*a*, a projection 16*b*, and engagement portions 16*c* through 16*f*. As shown in FIG. 5A, the base portion 16*a* is a circularly-shaped plate member when viewed from above in the z-axis direction. A principal surface of the base portion 16*a* on the negative direction side of the z-axis direction is referred to as an "upper surface S1", and a principal surface of the base portion 16*a* on the positive direction side of the z-axis direction is referred to as a "lower surface S2".

The projection 16*b* is provided on the negative direction side of the y-axis direction relative to the base portion 16*a*, and projects toward the negative direction side of the z-axis direction relative to the base portion 16*a*.

The engagement portions 16*c* through 16*f* radially project as the base portion 16*a* being centered when viewed from above in the z-axis direction. More specifically, the engagement portion 16*c* extends from the base portion 16*a* toward the positive direction side of the y-axis direction and the negative direction side of the x-axis direction. The engagement portion 16*d* extends from the base portion 16*a* toward the positive direction side of the y-axis direction and the positive direction side of the x-axis direction. The engagement portion 16*e* extends from the base portion 16*a* toward the negative direction side of the y-axis direction and the negative direction side of the x-axis direction. The engagement portion 16*f* extends from the base portion 16*a* toward the negative direction side of the y-axis direction and the positive direction side of the x-axis direction.

The center conductor member 14 is attached to the insulating member 16. To be more specific, as shown in FIG. 1, the center conductor member 14 and the insulation member 16 are integrally formed through insert molding of resin material. With this, the first center conductor 14*a* projects toward the negative direction side of the z-axis direction at the center of the base portion 16*a*. Further, an end portion of the first center conductor 14*a* on the positive direction side of the z-axis direction is exposed from the lower surface S2 of the insulation member 16. In addition, the outer terminal 14*b* of the center conductor member 14 is extended from the insulation member 16 toward the negative direction side of the y-axis direction, on the positive direction side of the z-axis direction of the projection 16*b*.

Figure 12:
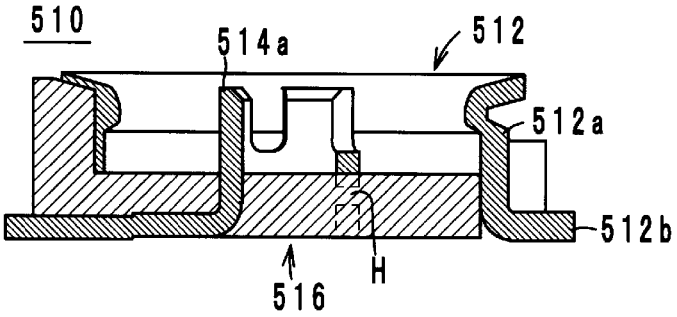
FIG. 12 PRIOR ART
FIG. 12 is a cross-sectional structure view of the coaxial connector plug disclosed in Japanese Unexamined Patent Application Publication NO. 2013-98122.
Figure 13:
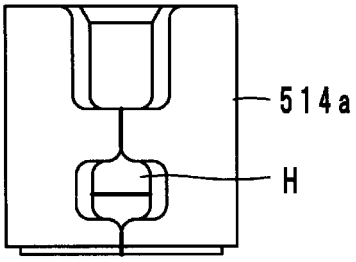
FIG. 13 PRIOR ART
FIG. 13 is a planar view of the center conductor, viewed from the front side, of the coaxial connector plug disclosed in Japanese Unexamined Patent Application Publication NO. 2013-98122.

The insulation member 16, as shown in FIG. 5B, penetrates from the outside to the inside of the first center conductor 14*a* through the communication section h. With this, at the inside of the first center conductor 14*a*, the vicinity of the end portion thereof on the positive direction side of the z-axis direction is filled with the insulation member 16. As shown in FIG. 12, in the case where the insulation member 516 is allowed to penetrate to the inside of the center conductor 514*a* through the hole H by insert molding, there is a case where a weld-line is generated in the molded insulation member because an end portion of the center conductor located in the vicinity of the hole H on the positive direction side of the z-axis direction obstructs the flow of resin. This weld-line causes the strength of the insulation member to be lowered. However, in the case of the communication section h, shown in FIG. 5B, which is formed by cutting out an end portion of the first center conductor 14*a*, because the end portion of the first center conductor 14*a* is not present on the positive direction side of the z-axis direction of the communication section h, the flow of resin is not obstructed by the end portion of the first center conductor 14*a* positioned on the positive direction side of the z-axis direction of the communication section h during the insert molding. This makes it possible to suppress the generation of weld-lines.

The outer conductor member 12 is attached to the insulation member 16. More specifically, an end portion of the first outer conductor 12*a* on the positive direction side of the z-axis direction makes contact with the upper surface S1 of the base portion 16*a*, as shown in FIG. 1. With this, the base portion 16*a* covers an opening of the first outer conductor 12*a* on the positive direction side of the z-axis direction. Further, the outer terminals 12*c* through 12*f* are engaged with the engagement portions 16*c* through 16*f*, respectively. More specifically, the outer terminal 12*c* is extended from the negative direction side of the x-axis direction of the engagement portion 16*c* to the positive direction side of the z-axis direction of the engagement portion 16*c*. The outer terminal 12*d* is extended from the positive direction side of the x-axis direction of the engagement portion 16*d* to the positive direction side of the z-axis direction of the engagement portion 16*d*. The outer terminal 12*e* is extended from the negative direction side of the x-axis direction of the engagement portion 16*e* to the positive direction side of the z-axis direction of the engagement portion 16*e*. The outer terminal 12*f* is extended from the positive direction side of the x-axis direction of the engagement portion 16*f* to the positive direction side of the z-axis direction of the engagement portion 16*f*. Further, the outer terminal 12*b* is extended toward the positive direction side of the z-axis direction between the engagement portion 16*c* and the engagement portion 16*d*. With this, the insulation member 16 is provided on the positive direction side of the z-axis direction with respect to the first outer conductor 12*a*.

The projection 16*b* is, as shown in FIG. 1, located inside the cut section S. In other words, the projection 16*b* functions as a cover member for closing the cut section S. However, the projection 16*b* is not in contact with the first outer conductor 12*a*. That is, there exists a small space between the projection 16*b* and the first outer conductor 12*a*. This makes it possible for the first outer conductor 12*a* to slightly deform in a direction such that the diameter thereof becomes smaller.

Coaxial Connector Receptacle

Figure 6:
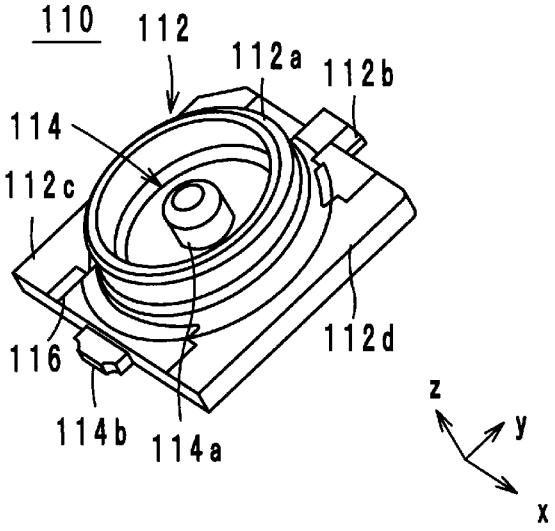
FIG. 6 is an exterior perspective view of a coaxial connector receptacle according an embodiment of the present disclosure.
Figure 7:
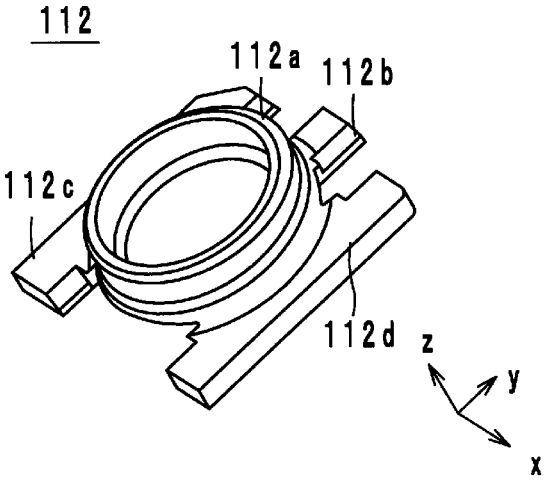
FIG. 7 is an exterior perspective view of an outer conductor member of the coaxial connector receptacle.
Figure 8:
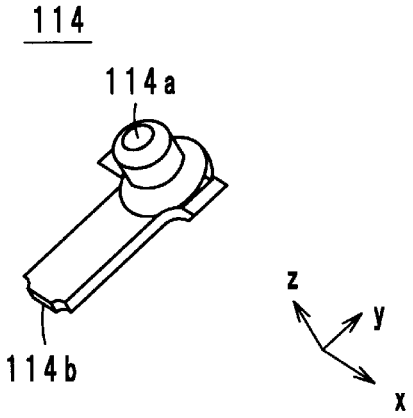
FIG. 8 is an exterior perspective view of a center conductor member of the coaxial connector receptacle.
Figure 9:
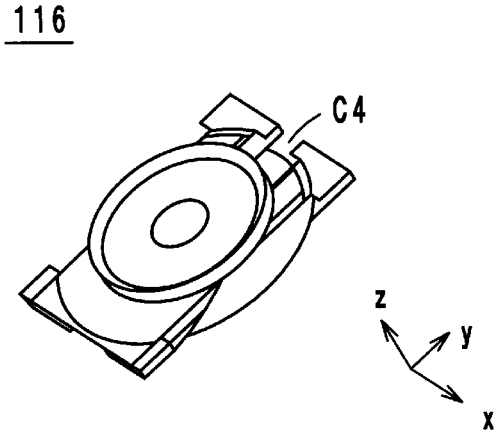
FIG. 9 is an exterior perspective view of an insulation member of the coaxial connector receptacle.

Next, a coaxial connector receptacle, which is attached to the coaxial connector plug 10, according to an embodiment of the present disclosure will be described with reference to the drawings. FIG. 6 is an exterior perspective view of a coaxial connector receptacle 110 according an embodiment of the present disclosure. FIG. 7 is an exterior perspective view of an outer conductor member 112 of the coaxial connector receptacle 110. FIG. 8 is an exterior perspective view of a center conductor member 114 of the coaxial connector receptacle 110. FIG. 9 is an exterior perspective view of an insulation member 116 of the coaxial connector receptacle 110.

Hereinafter, in FIG. 6, the normal direction of the insulation member 116 is defined as a z-axis direction; the directions parallel to two sides of the insulation member 116, when viewed from above in the z-axis direction, are defined as an x-axis direction and a y-axis direction, respectively. The x-axis direction, the y-axis direction, and the z-axis direction are orthogonal to one another. Note that the z-axis direction is parallel to the vertical direction.

The coaxial connector receptacle 110 is attached to the coaxial connector plug 10 from the lower side thereof. In other words, when the coaxial connector receptacle 110 is in use, the coaxial connector receptacle 110 is used with an opening thereof facing upward. Accordingly, the upper direction in FIG. 6 means an upward direction of the vertical direction, and the lower direction in FIG. 6 means a downward direction of the vertical direction. As such, the upper direction in FIG. 6 is defined as a positive direction of the z-axis direction, while the lower direction in FIG. 6 is defined as a negative direction of the z-axis direction.

The coaxial connector receptacle 110 is mounted on a circuit board such as a flexible print board or the like, and includes the outer conductor member 112, the center conductor member 114, and the insulation member 116, as shown in FIG. 6.

The outer conductor member 112 is manufactured by performing punching and bending processes on a single metal plate (for example, phosphorus bronze) having conductivity and elasticity. In addition, nickel plating, and silver plating or gold plating are performed on the outer conductor member 112. As shown in FIGS. 6 and 7, the outer conductor member 112 includes a second outer conductor 112*a* and outer terminals 112*b* through 112*d*. The second outer conductor 112*a* is formed substantially in a cylinder shape extending in the z-axis direction, as shown in FIGS. 6 and 7.

The outer terminals 112*b* through 112*d* are connected with the second outer conductor 112*a*, and provided on the negative direction side of the z-axis direction of the second outer conductor 112*a*. The outer terminal 112*b* is extended from the second outer conductor 112*a* toward the negative direction side of the z-axis direction and folded back toward the positive direction side of the y-axis direction. The outer terminal 112*c* is extended from the second outer conductor 112*a* toward the negative direction side of the z-axis direction and folded back toward the negative direction side of the x-axis direction. Note that the outer terminal 112*c* is substantially T-shaped when viewed from above in the z-axis direction. The outer terminal 112*d* is extended from the second outer conductor 112*a* toward the negative direction side of the z-axis direction and folded back toward the positive direction side of the x-axis direction. The outer terminal 112*d* is also substantially T-shaped when viewed from above in the z-axis direction.

The center conductor member 114 is manufactured by performing punching and bending processes on a single metal plate (for example, phosphorus bronze). In addition, nickel plating, and silver plating or gold plating are performed on the center conductor member 114. As shown in FIGS. 6 and 8, the center conductor member 114 includes a second center conductor 114*a* and an outer terminal 114*b*.

The second center conductor 114*a* is, as shown in FIG. 6, so provided as to extend in the z-axis direction at the center of the second outer conductor 112*a*. That is, the second center conductor 114*a* is surrounded by the second outer conductor 112*a* when viewed from above in the z-axis direction. Further, as shown in FIG. 8, the second center conductor 114*a* is formed in a column shape extending in the z-axis direction.

As shown in FIG. 8, the outer terminal 114*b* is connected with an end portion of the second center conductor 114*a* on the negative direction side of the z-axis direction, and extends toward the negative direction side of the y-axis direction. The outer terminal 114*b* opposes the outer terminal 112*b* sandwiching the center of the second outer conductor 112*a* therebetween when viewed from above in the z-axis direction, as shown in FIG. 6.

The insulation member 116 is made from an insulative material such as resin or the like, and has a rectangular shape when viewed from above in the z-axis direction, as shown in FIGS. 6 and 9. Note that a cutout C4 is provided in the insulation member 116. The cutout C4 is formed by removing a center portion of a side of the insulation member 116 on the positive direction side of the y-axis direction.

The outer conductor member 112, the center conductor member 114, and the insulation member 116 are integrally formed through insert molding. Through this, the second outer conductor 112*a* projects toward the positive direction side of the z-axis direction at the center of the insulation member 116. Further, an end portion of the second outer conductor 112*a* on the negative direction side of the z-axis direction is covered by the insulation member 116. The outer terminal 112*b* is extended out to the outside of the insulation member 116 through the cutout C4. Furthermore, the outer terminals 112*c* and 112*d* are extended out to the outside of the insulation member 116 from a side of the insulation member 116 on the negative direction side of the x-axis direction and a side thereof on the positive direction side of the x-axis direction, respectively. The second center conductor 114*a* projects from the insulation member 116 toward the positive direction side of the z-axis direction in a region surrounded by the second outer conductor 112*a*. The outer terminal 114*b* is extended from the insulation member 116 toward the negative direction side of the y-axis direction.

Attachment of Coaxial Connector Receptacle to Coaxial Connector Plug

Figure 10:
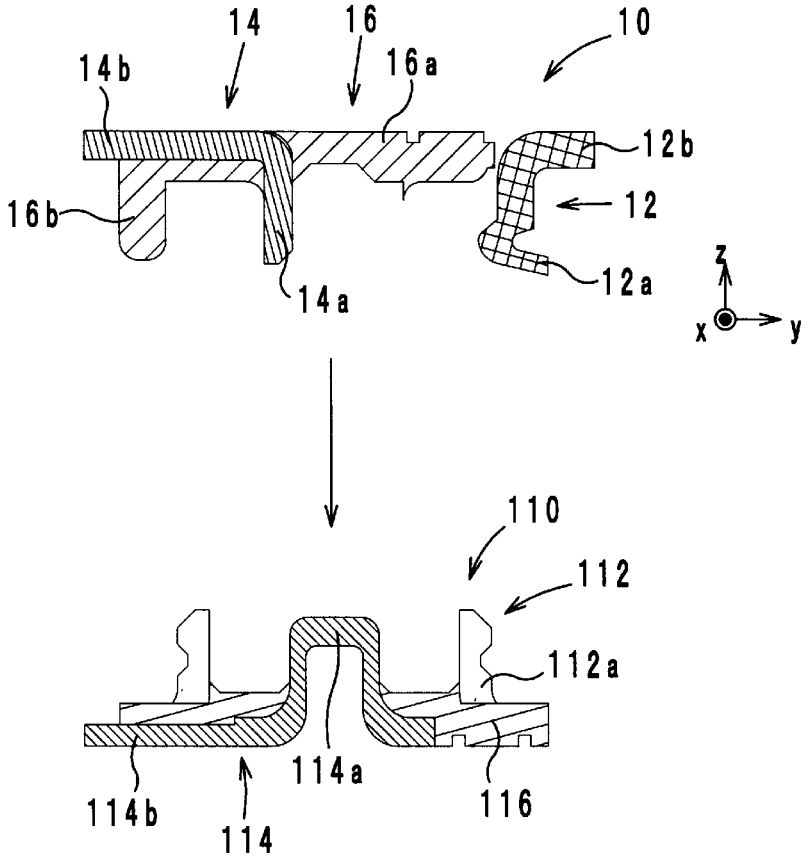
FIG. 10 is a cross-sectional structure view of the coaxial connector plug and the coaxial connector receptacle before being attached.
Figure 11:
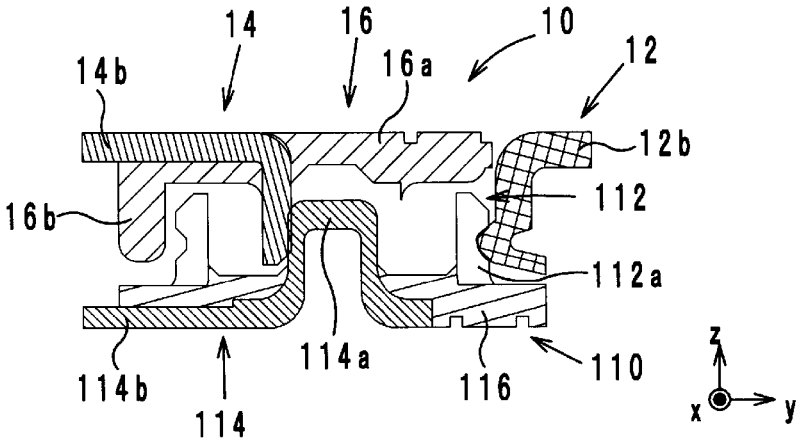
FIG. 11 is a cross-sectional structure view of the coaxial connector plug and the coaxial connector receptacle after being attached.

Hereinafter, attachment of the coaxial connector receptacle 110 to the coaxial connector plug 10 will be described with reference to the drawings. FIG. 10 is a cross-sectional structure view of the coaxial connector plug 10 and the coaxial connector receptacle 110 before the attachment. FIG. 11 is a cross-sectional structure view of the coaxial connector plug 10 and the coaxial connector receptacle 110 after the attachment.

As shown in FIG. 10, the coaxial connector plug 10 is used in a state in which the opening of the first outer conductor 12*a* faces toward the negative direction side of the z-axis direction. Then, as shown in FIG. 11, the coaxial connector receptacle 110 is attached to the coaxial connector plug 10 from the negative direction side of the z-axis direction. To be more specific, the second outer conductor 112*a* is inserted into the first outer conductor 12*a* from the negative direction side of the z-axis direction. The diameter of the outer circumference surface of the second outer conductor 112*a* is designed to be slightly larger than the diameter of the inner circumference surface of the first outer conductor 12*a*. This causes the outer circumference surface of the second outer conductor 112*a* to make press-contact with the inner circumference surface of the first outer conductor 12*a*, so that the first outer conductor 12*a* is expanded in the horizontal direction by the second outer conductor 112*a*. In other words, the first outer conductor 12*a* is expanded so that the width of the overall cut section S becomes larger. Then, concavo-convex portions on the inner circumference surface of the first outer conductor 12*a* and concavo-convex portions on the outer circumference surface of the second outer conductor 112*a*, are engaged with each other. With this, the first outer conductor 12*a* holds the second outer conductor 112*a*. The first outer conductor 12*a* and the second outer conductor 112*a* are kept at the ground potential in use.

The first center conductor 14*a* is connected with the second center conductor 114*a*. More specifically, as shown in FIG. 11, the second center conductor 114*a* is inserted into the first center conductor 14*a* formed in a cylinder shape. The diameter of the outer circumference surface of the second center conductor 114*a* is designed to be slightly larger than the diameter of the inner circumference surface of the first center conductor 14*a*. This causes the outer circumference surface of the second center conductor 114*a* to make press-contact with the inner circumference surface of the first center conductor 14*a*, so that the first center conductor 14*a* is expanded so as to be bent backward in the horizontal direction by the second outer conductor 114*a*. With this, the first center conductor 14*a* holds the second center conductor 114*a*. A high-frequency signal current flows in the first center conductor 14*a* and the second center conductor 114*a* in use.

Effects

According to the coaxial connector plug 10 configured in the manner described above, the first center conductor 14*a* can be suppressed from being detached from the insulation member 16. To be more specific, in the coaxial connector plug 10, the communication section h configured to cause the inside and the outside of the first center conductor 14*a* to communicate with each other is provided in the end portion of the first center conductor 14*a* on the positive direction side of the z-axis direction. With this, the insulation member 16 penetrates from the outside to the inside of the first center conductor 14*a* through the communication section h. This suppresses the first center conductor 14*a* from being easily detached from the insulation member 16 in the coaxial connector plug 10.

Further, in the coaxial connector plug 10, the width in the x-axis direction of the communication section h is larger as it progresses from the positive direction side toward the negative direction side of the z-axis direction. With this, in the case where the first center conductor 14*a* is pulled toward the negative direction side of the z-axis direction, an end portion of the inner circumference surface of the communication section h on the positive direction side of the z-axis direction is caught by the insulation member 16 located within the communication section h. This suppresses the first center conductor 14*a* from being easily detached from the insulation member 16 in the coaxial connector plug 10.

Furthermore, in the coaxial connector plug 10, the communication section h of the first center conductor 14*a* is located in the end portion of the first center conductor 14*a* on the positive direction side of the z-axis direction. On the other hand, in the case of the coaxial connector plug 510 disclosed in Japanese Unexamined Patent Application Publication NO. 2013-98122, the hole H is located at a upper position relative to the lower end of the first center conductor 14*a*. Accordingly, the height of the first center conductor 14*a* in the z-axis direction is lower than the height of the center conductor 514*a* in the vertical direction. As a result, the low-profiling of the coaxial connector plug 10 is realized.

Other Embodiments

The coaxial connector plug according to the present disclosure is not intended to be limited to the above-described coaxial connector plug 10, and can be modified without departing from the spirit and scope of the disclosure.

It is sufficient that at least one of the cutouts Ha and Hb is provided.

The shape of the communication section h is not intended to be limited to an upside-down isosceles trapezoid. In addition, it is not necessary that the width of the communication section h in the x-axis direction is smaller as it progresses from the positive direction side toward the negative direction side of the z-axis direction across the overall communication section h, and it is sufficient that the width thereof is smaller as it progresses from the positive direction side toward the negative direction side of the z-axis direction in at least part of the communication section h. The width of the communication section h may change continuously to be smaller as it progresses from the positive direction side toward the negative direction side of the z-axis direction, or may become smaller in steps.

As has been described thus far, the present disclosure is useful for coaxial connector plugs, and is particularly excellent in that the height of the coaxial connector plugs can be lowered.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coaxial connector receptacle comprising:

a first outer conductor in a cylinder shape extending in a first direction;

a first center conductor in a cylinder shape extending in the first direction and at an inside of the first outer conductor; and an insulation member penetrating the first center conductor and the first outer conductor, wherein a communication section configured to cause an inside and an outside of the first center conductor to communicate with each other, and the communication section is provided at an endmost portion of the first center conductor on one bottom side in the first direction, a width of the communication section extending in a second direction, which is orthogonal to the first direction, a height of the communication section extending in the first direction, and the width is larger progressing from the one bottom side toward another top side of the first direction in at least part of the communication section, the insulation member penetrates from the outside to the inside of the first center conductor through the communication section, and the communication section is formed through a sidewall of the cylinder shape of the first center conductor and is open on the one bottom side of the first center conductor in the first direction, wherein the first center conductor comprises:

first and second fingers extending from a base of the first center conductor in opposite directions in the second direction, and third and fourth fingers extending in parallel from the base of the first center conductor in the first direction.

2. The coaxial connector receptacle according to claim 1, wherein the insulation member closes an opening of the first outer conductor on one side in the first direction, and the endmost portion of the first center conductor on the one side in the first direction is exposed from a surface of the insulation member on one side in the first direction.

3. The coaxial connector receptacle according to claim 1, wherein the insulation member is made from resin.

4. The coaxial connector receptacle according to claim 1, wherein a cylinder-shaped second outer conductor of a coaxial connector plug is inserted into the first outer conductor, and a second center conductor of the coaxial connector plug is inserted into the first center conductor.

5. The coaxial connector receptacle according to claim 1, wherein the first center conductor is configured such that a belt-shaped plate member is bent in a circular form so that both ends in a longitudinal direction of the plate member are bonded.

6. The coaxial connector receptacle according to claim 5, wherein the communication section is formed by providing a cutout in at least one of both ends in the longitudinal direction of the plate member.

7. A coaxial connector receptacle configured to be mounted on a circuit board, the coaxial connector receptacle comprising:

a first outer conductor in a cylinder shape extending in a mating direction;

a first center conductor in a cylinder shape extending in the mating direction and at an inside of the first outer conductor; and an insulation member penetrating the first center conductor and the first outer conductor, wherein a communication section is a clearance section formed in a side wall of the first center conductor, the communication section extending from an inner side of the side wall of the first center conductor to an outer side of the side wall of the first center conductor, and the communication section is provided at an endmost portion of the first center conductor on a first bottom side extending in a direction opposite the mating direction, a width of the communication section extending in a width direction, which is orthogonal to the mating direction, a height of the communication section extending in the mating direction, and the width is larger progressing from the first bottom side toward a second top side of the mating direction in at least part of the communication section, the insulation member extends from the outer side to the inner side of the first center conductor through the communication section, and the communication section is formed through a sidewall of the cylinder shape of the first center conductor and is open on the one bottom side of the first center conductor in the mating direction, wherein the first center conductor comprises:

first and second fingers extending from a base of the first center conductor in opposite directions in the width direction, and third and fourth fingers extending in parallel from the base of the first center conductor in the mounting direction.

8. The coaxial connector receptacle according to claim 7, wherein the insulation member closes an opening of the first outer conductor on first side in the mating direction, and the endmost portion of the first center conductor on the first side in the mating direction is exposed from a surface of the insulation member on first side in the mating direction.

9. The coaxial connector receptacle according to claim 7, wherein the insulation member is made from resin.

10. The coaxial connector receptacle according to claim 7, wherein a cylinder-shaped second outer conductor of a coaxial connector plug is inserted into the first outer conductor, and a second center conductor of the coaxial connector plug is inserted into the first center conductor.

11. The coaxial connector receptacle according to claim 7, wherein the first center conductor is configured such that a belt-shaped plate member is bent in a circular form so that both ends in a longitudinal direction of the plate member are bonded.

12. The coaxial connector receptacle according to claim 11, wherein the communication section is formed by providing a cutout in at least one of both ends in the longitudinal direction of the plate member.

* * * * *